United States Patent [19]

Hosbein

[11] 4,130,256

[45] Dec. 19, 1978

[54] WIRE CARRYING SPOOL

[75] Inventor: Hugh W. Hosbein, Fort Wayne, Ind.

[73] Assignee: Mossberg Hubbard, a division of Wanskuck Company, Garrett, Ind.

[21] Appl. No.: 852,865

[22] Filed: Nov. 18, 1977

[51] Int. Cl.[2] ..... B65H 75/14

[52] U.S. Cl. ..... 242/118.4; 242/118.6; 242/118.7

[58] Field of Search ..... 242/118.4, 118.6, 118.7, 242/118.8, 118.61, 118.62, 115, 77, 77.3, 77.4, 118.31, 118.3, 118.32

[56] References Cited

U.S. PATENT DOCUMENTS

| | | | |
|---|---|---|---|
| 1,265,110 | 5/1918 | Prentiss | 242/115 |
| 1,361,250 | 12/1920 | Green | 242/118.62 |
| 1,772,303 | 8/1930 | Bauman | 242/118.6 X |
| 1,949,291 | 2/1934 | Barthelmes | 242/118.1 |
| 3,462,097 | 8/1969 | Wilson | 242/118.4 |
| 3,480,229 | 11/1969 | D'Entremont | 242/118.4 |

FOREIGN PATENT DOCUMENTS

| | | | |
|---|---|---|---|
| 1100633 | 4/1955 | France | 242/118.6 |
| 512801 | 9/1939 | United Kingdom | 242/118.62 |

*Primary Examiner*—George F. Mautz

*Attorney, Agent, or Firm*—Gust, Irish, Jeffers & Rickert

[57] ABSTRACT

A spool barrel has flat sides which preferably are tapered from one end to the other. Rounded corners are formed between adjacent side edges. Each of the corners has a plurality of wire receiving ridges whereby the first or base layer of wire windings on the spool will nest in the grooves or channels between the ridges and be held thereby against axial movement on the spool barrel. A molded spool barrel having an integral molded lower flange has a molded upper flange removably attached to the upper barrel end.

1 Claim, 5 Drawing Figures

WIRE CARRYING SPOOL

BACKGROUND OF THE INVENTION

1. Field of the Invention

This invention is in the field of wire carrying spools, and more particularly relates to a spool construction for maintaining wire windings on the spool barrel, of inexpensive manufacture and molded configuration.

2. Description of the Prior Art

In general, wire-carrying spools have a body or barrel with upper and lower flanges. The spool barrels are cylindrical or of frusto-conical configuration. During winding, the wire has been moved axially to and fro on the barrels to obtain even wire layers. During continuous winding, even wire layers generally were obtainable but during any stoppage, enlargement of the wire coils about the spool tended to occur and the coils would fall downwardly out of place and become bunched at one end of the spool body.

With respect to the winding of wire, wherein the spool is rotating and wire is being fed to the spool, with the spool in upright position, sudden stoppage of spool rotation can result in undesired enlargement of the coils due to a continuing wire feed and the inertia of the wire. If the spool barrel is cylindrical, the enlarged coils fall and bunch near the bottom of the spool. Before winding can be resumed, it is necessary to restore the loosened coils to a flat wrapping which results in costly down time.

SUMMARY OF THE INVENTION

A wire carrying spool is provided with flat barrel sides formed about the spool axis. One such barrel design is polygonal in cross-section and tapered from one end to the other. The corners are slightly rounded and provided with circumferential helically arranged ridges spaced axially a suitable distance related to the diameter of the wire. A base layer of wire wound on the barrel flattens against the sides thereof and fits between the ridges which thereby hold the individual coils in position. Subsequent layers are wound over this base layer.

During removal of wire from or application of wire to the spool, undesired unwinding of the coils is resisted upon sudden stoppage of the process by reason of the flats and corners of the windings. With the spool upright, the combination of the ridges and flats as well as the taper of the barrel tends to maintain the integrity of the coils and layers resisting undesired unwinding and gravitational bunching of the coils.

The ridges on successive corners of the spool are axially displaced to facilitate helical winding of the wire on the spool body. Subsequent wire layers are retained due to the polygonal configuration of each wire coil. The flat segments of the coil encounter interference by the corners of the body thereby inhibiting any tendency of the coils to unwind and enlarge.

The spool is constructed of a molded, ridged barrel having a stepped peripheral shoulder at its upper end for receiving and supporting an upper molded flange. The barrel has a molded integral flange at its lower end and a central opening for receiving at the bottom end a barrel plate.

It is therefore an object of this invention to provide a wire carrying spool which has improved wire retaining ability.

Another object of this invention is to provide in the spool of the previous object means for retaining wire coils on the spool body during sudden stoppage of a rotating spool.

A further object is to provide a flanged spool construction of inexpensive manufacture which may be repaired, if damaged or worn, with facility.

A still further object is to provide in the spool of the previous object a spool having molded components including a spool barrel, with an integral lower flange, an upper flange, and lower end plate.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 2:
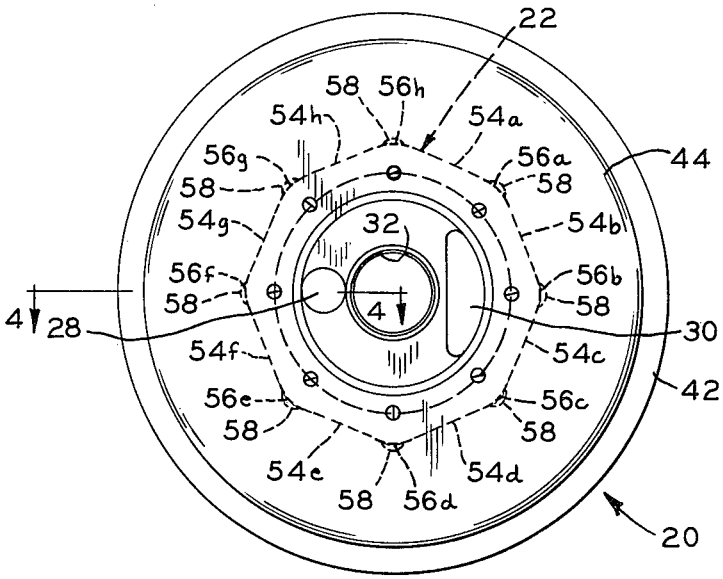
FIG. 2 is a top plan view of the embodiment of FIG. 1.
Figure 1:
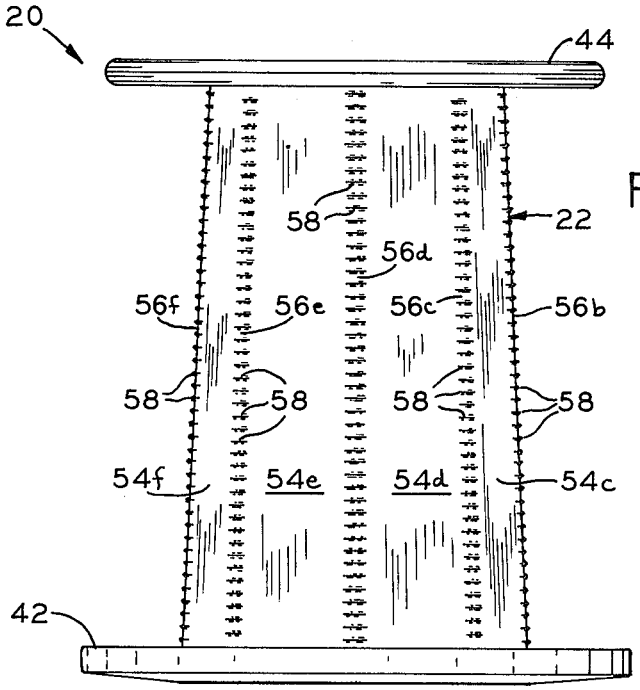
FIG. 1 is a side elevational view of a preferred embodiment of this invention having an octagonal barrel with rounded, ridged corners.
Figure 3:
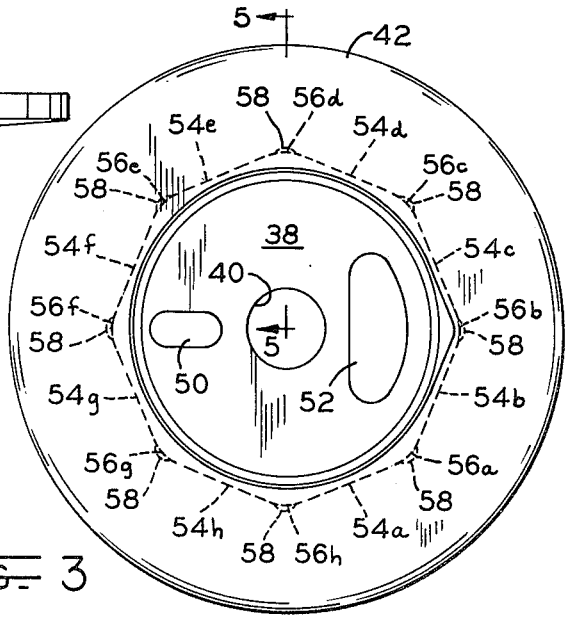
FIG. 3 is a bottom plan view of the spool of FIG. 1.
Figure 4:
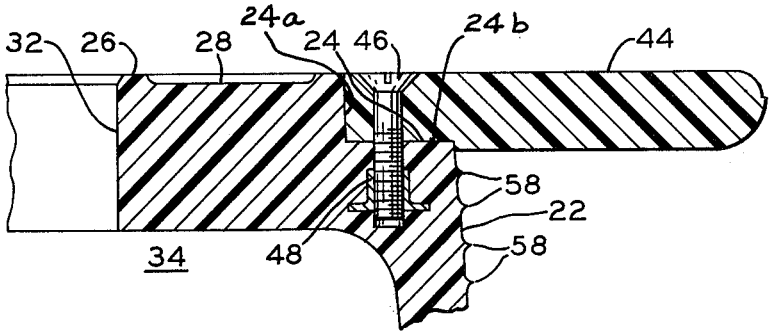
FIG. 4 is a partial section taken at section line 4—4 of FIG. 2.
Figure 5:
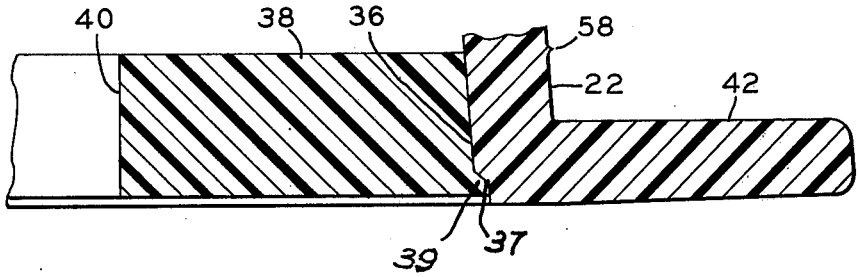
FIG. 5 is a partial section taken at section line 5—5 of FIG. 3.

Referring to FIGS. 1 to 5, a spool 20 has an octagonal tapered hollow body or barrel 22 defining a body chamber 23 and is provided at its upper end with an annular recess 24 having a vertical wall 24*a* and a radial ledge 24*b* (FIG. 4). Barrel 22 has an integral radial flange 25 inwardly projecting at its upper end. Flange 25 has an upper annular surface 26 provided with indentations 28 and 30 for receiving barrel supports not shown. Flange 25 further is provided with a central bore 32 which opens into the barrel chamber 23.

An opening 36 (FIG. 5) in the opposite end of barrel 22, has a tapered coaxial offset 37 which frictionally receives, with a pressfit a bottom plate 38 having a tapered shoulder 39 fitting closely in offset 37 and a central opening 40. Barrel 22 further has integrally formed at its lower end an outwardly extending annular flange 42. An upper annular flange 44 is fitted into recess 24 in intimate engagement with circumferential wall 24*a* and annular ledge 24*b*. Flange 44 is attached to barrel 22 by means of fasteners 46 which threadedly engage threaded inserts 48 molded into barrel 22. Barrel 22, plate 38 and flange 44 may be molded of a suitable plastic such as polyurethane. Plate 38 has on its lower surface recesses 50 and 52 (FIG. 3) formed therein for receiving barrel supporting members, not shown.

Barrel 22 is generally tapered and octagonal in cross-section, having flat sides 54*a*, 54*b*, 54*c*, 54*d*, 54*e*, 54*f*, 54*g*, and 54*h*. The corners 56*a* to 56*h* formed between the edges of respective sides 54*a* to 54*h* are slightly rounded as shown. Each corner is ridged with a plurality of axially spaced arcuate ridges 58 defining wire receiving channels therebetween with the axial spacing between ridge centers in one embodiment being 3/16 of an inch with the width of the ridge being about 0.062 inches and the ridge height about 0.046 inches. The ridges 58 on one corner are axially displaced 3/32 of an inch from the ridges on the next circumferentially succeeding corner so that the ridges on corner 56*b*, for example, are axially displaced 3/32 inches from ridges 58 on corner 56c. In this manner, the helical winding or unwinding of wire onto or from the barrel 22 is accomplished by either rotating spool 20 in a conventional manner or by using a conventional de-reeling device in conjunction with a stationary spool.

Due to the ridges 58 and the flat sides 54a to 54h, the wire tends to flatten against the sides and to be retained thereon following the sudden stoppage of wire take-up in a de-reeling device or stoppage of a rotating spool during unwinding of wire. With wire being wound onto a rotating spool, by means of conventional apparatus that feeds the wire at a substantially uniform speed, should the spool be suddenly stopped, unravelling or enlargement of the coils on the barrel due to a continuing feed and wire inertia is resisted by reason of the flat portions of the wire engaging the corners. Further by reason of the barrel taper, should any loosening of the coils occur, they will be frictionally inhibited from falling. Thus, the position of the coils and layers on the barrel is maintained during repeated starts and stops of winding or unwinding wire. The teaching of this invention also may be applied to cylindrical or frusto-conical barrels by placing helical continuous or interrupted ridges on the outer barrel surface.

Of importance is the fact that the spool consists essentially of three molded plastic parts, the barrel 22 with flange 42, the annular flange 44 and the disc-shaped insert 38. Should one of barrel or flange 44 become worn or damaged, the flange 44 is removed by unscrewing threaded fasteners 46. The plate 38 may be dislodged by pressing it outwardly. Depending on which part is unserviceable, it is replaced by a new part and the spool is then reassembled. Thus, instead of discarding the entire spool, the serviceable parts are retained. An economy is thereby achieved by retaining the serviceable parts.

For a working embodiment, the following dimensions in addition to those given in the foregoing are provided, these being exemplary only and not to be considered as limitative of this invention, the drawings otherwise being substantially to scale.

Outer diameter of flange 44 — 10 inches
Thickness of flanges 42 and 44 — ½ inch
Radius of barrel 22 at upper end at corners 56 — 3 inches
Radius of barrel 22 at lower end at corners 56 — 3½ inches
Overall length of spool — 13-1/6 inches
Outer diameter of flange 42 — 11 inches
Wire sizes useable with spool While there have been described above the principles of this invention in connection with specific apparatus, it is to be clearly understood that this description is made only by way of example and not as a limitation to the scope of the invention.

What is claimed is:

1. A wire carrying spool comprising a barrel having a barrel axis;

said barrel being frusto-pyramidal having wire receiving barrel sides inclined from one spool end to the other;

said barrel having corners formed between adjacent side edges;

said corners each having a plurality of axially spaced ridges formed thereon to define wire receiving channels whereby wire windings will nest in said channels for maintaining axial wire placement;

said ridges of circumferentially adjacent corners being axially displaced thereby defining helically disposed wire receiving grooves on said barrel corners;

said barrel having an integral flange on one end, a demountable flange on the other end of said barrel, said demountable flange being removably secured to said barrel by means of threaded fasteners;

said other end of said barrel being formed with an annular recess having a cylindrical wall portion of smaller diameter than the outer dimension of said barrel and a radial ledge, said demountable flange having a central opening snugly received over said cylindrical wall portion and supportably engaged with said radial ledge, and a plurality of circumferentially spaced fasteners extending axially of said barrel passing through said demountable flange and removably fastenable to said barrel; and said spool being hollow and internally tapered outwardly at said one end, and including a plate-like insert having an outer periphery conforming to said tapered portion and press-fitted therein to a position at which one surface thereof is substantially co-planar with the end surface of said integral flange.

* * * * *